US009326331B2

(12) United States Patent
Ekemar et al.

(10) Patent No.: US 9,326,331 B2
(45) Date of Patent: Apr. 26, 2016

(54) METHOD AND APPLIANCE FOR REDUCING AND ELIMINATING LOCAL AREAS OF OVERHEATING IN SENSITIVE LOADS OF DIELECTRIC MATERIALS

(75) Inventors: Lars Ekemar, Gnesta (SE); Pierre Westin, Täby (SE)

(73) Assignee: ANTRAD MEDICAL AB, Stockholm (SE)

( * ) Notice: Subject to any disclaimer, the term of this patent is extended or adjusted under 35 U.S.C. 154(b) by 262 days.

(21) Appl. No.: 13/698,595

(22) PCT Filed: May 19, 2011

(86) PCT No.: PCT/SE2011/000087

§ 371 (c)(1),
(2), (4) Date: Nov. 16, 2012

(87) PCT Pub. No.: WO2011/145994

PCT Pub. Date: Nov. 24, 2011

(65) Prior Publication Data

US 2013/0056461 A1 Mar. 7, 2013

Related U.S. Application Data

(60) Provisional application No. 61/358,091, filed on Jun. 24, 2010.

(30) Foreign Application Priority Data

May 21, 2010 (SE) ..... 1000546

(51) Int. Cl.
*H05B 6/00* (2006.01)
*H05B 6/62* (2006.01)

(Continued)

(52) U.S. Cl.
CPC .. *H05B 6/62* (2013.01); *H05B 6/46* (2013.01); *H05B 6/56* (2013.01); *H05B 6/58* (2013.01); *H05B 6/60* (2013.01); *H05B 6/6491* (2013.01); *H05B 6/6494* (2013.01); *H05B 6/6497* (2013.01); *H05B 2206/046* (2013.01)

(58) Field of Classification Search
CPC ..... H05B 6/00; H05B 6/62
USPC ..... 219/710, 730, 731, 745, 772, 687; 62/62, 66
See application file for complete search history.

(56) References Cited

U.S. PATENT DOCUMENTS 2,765,387 A * 10/1956 Lamont ..... 219/779
5,616,268 A * 4/1997 Carr ..... 219/687

(Continued)

FOREIGN PATENT DOCUMENTS

GB 599935 A 3/1948
WO WO-02/054833 A1 7/2002

OTHER PUBLICATIONS

International Preliminary Report on Patentability and Written Opinion dated Nov. 27, 2012 for International Application No. PCT/SE2011/000087.

*Primary Examiner* — Thien S Tran
(74) *Attorney, Agent, or Firm* — Moore & Van Allen PLLC; W. Kevin Ransom

(57) ABSTRACT

This invention is about a method and a device for equalizing warming processes in dielectric loads using electric/electromagnetic fields at frequencies below 900 MHz. Characteristic for the invention is that the load is surrounded by a field equalizing material and that the load and the electric/electromagnetic field is moved relative to each other.

7 Claims, 3 Drawing Sheets

(51) Int. Cl.

| | |
|---|---|
| ***H05B 6/46*** | (2006.01) |
| ***H05B 6/56*** | (2006.01) |
| ***H05B 6/58*** | (2006.01) |
| ***H05B 6/60*** | (2006.01) |
| ***H05B 6/64*** | (2006.01) |

(56) References Cited

U.S. PATENT DOCUMENTS

| | | | |
|---|---|---|---|
| 6,246,040 | B1 | 6/2001 | Gunn |
| 2002/0112364 | A1 | 8/2002 | Yano et al. |

* cited by examiner

METHOD AND APPLIANCE FOR REDUCING AND ELIMINATING LOCAL AREAS OF OVERHEATING IN SENSITIVE LOADS OF DIELECTRIC MATERIALS

BACKGROUND OF THE INVENTION

It is known that electromagnetic fields can be used for thawing, warming and treating different loads consisting of dielectric materials. Examples of such dielectric materials are proteins, wood pulp, alcohols and salts dissolved in water. Examples of electromagnetic fields include microwaves, (frequencies above 900 MHz) and radio fields (frequencies below 900 Mhz). There are many examples of demanding medical and industrial applications requiring a fast and homogenous warming (i.e., even field distribution). One example is a bag with 250 ml frozen blood plasma intended for transfusion, another example is a bag of frozen stem cells, but it can also be about controlling different chemical processes such as the acetylating of wood.

A common problem of warming with microwaves is that the wavelength is short, at 2500 MHz, (the commercial microwave frequency) the wavelength is 12 cm in vacuum/air and in most dielectric loads the wavelength is 2-5 cm. At frequencies used regularly in microwave products hotspots are common due to reflection and interference. A high frequency will also result in development of superficial energy.

The energy development in a dielectric material is determined by following relationship.

$$W=\in'*\tan(\delta)*f*E^2$$

Wherein W is the power, $\in'$ is the constant of dielectricity, tan(δ) is the loss factor, f is the frequency and E is the field strength.

A measure of the energy distribution is the penetration of depth which is defined by $\delta=c/\pi*f\sqrt{\in}*\tan(\delta)$ where c is the speed of light in vacuum.

In order to avoid hotspots as a result of reflection and interference and obtain a more homogenous warming process, a lower frequency can be applied. The wavelength in the load increases, as a result, the homogeneity of the warming process improves and the problems with so called hot spots are reduced and possibly eliminated.

If a longer wavelength (lower frequency) is applied, at unmodified power and dielectricity values, the field strength will increase compared with higher frequency. The power generation is a function of E2, therefore a relatively small increase of the field strength at a lower frequency will result in a considerable increase of the power generation compared with higher frequencies.

At transitions between load and surrounding air; at corners/edges and protrusive parts, an increase of the field strength with correlating heat generation often appear. It depends on the wavelength: the longer the waves are, the easier the field lines will turn around corners/edges and protrusive parts with a correlating increase in field strength.

Warming a load with electromagnetic fields without any local overheating requires that the wavelength is long enough in relation to reflection and interference phenomena and that the turning around corners/edges and protrusive parts is reduced or preferably eliminated. It is favorable if this can be done without considerable energy losses.

At frequencies below 900 MHz the probability for distinct hotspots is reduced and at frequencies below 300 MHz it is negligible. At shorter wavelengths the energy is more concentrated at the extinction points compared with longer wavelengths. This is especially valid if the load has a large constant of dielectricity that will additionally shorten the wavelength. However, at longer wavelengths the problems with overheating increase due to the turning of the electromagnetic fields/field lines at corners, edges and protrusive parts.

In order to solve the problem with turning of field lines at protrusive parts different solutions have been suggested.

In patent UK 599,935 a dielectric load is placed in a liquid with the same constant of dielectricity and loss factor as the load that is being heated. If there is enough of the surrounding liquid local overheating is eliminated on/in the load. The disadvantage with this solution is that the major part of the energy is absorbed by the surrounding liquid resulting in a negative energy aspect. Further a controlled and repetitive warming process of a dielectric load is made more difficult because the temperature of the surrounding liquid is altered/changed due to accumulated energy absorption contributing to the warming of the load.

In patent WO 02/054833 the dielectric load is surrounded with a dielectric material having a dielectric constant similar to the dielectric constant of the load but the loss factor of the surrounding material is small compared with the loss factor of the load. In this patent the load of a blood fraction, for example frozen blood plasma intended for transfusion is stored in a PVC bag. In that way, the turning of the electromagnetic fields/field lines at corners, edges and protrusive parts is reduced as well as no energy is absorbed in the surrounding material.

It is difficult to obtain a solution with identical dielectric constants of the load and the surrounding material. Pockets of air may also appear between the load and the surrounding material/liquid that may cause concentration of the electric/electromagnetic field to certain areas that will result in parts of the dielectric load being warmer than others.

If the load consists of perishable materials such as blood fractions intended for transfusion local overheating can result in devastating consequences.

Other biological materials such as frozen stem cells, organs intended for transfusion, etc. for the same reasons, require a homogenous thawing/warming process.

There are other applications that will benefit from a fast and homogenous thawing and warming process. One application is frozen fish and meat used as raw material in food processing industry. These raw materials are usually stored in frozen 10 kg blocks and have to be thawed before processing. Because of hygienic reasons, the surface has to be kept cold; therefore such blocks of fish and meat are thawed slowly in cold-storage rooms. The slow thawing process generates considerable capital costs and requires considerable planning efforts in order to achieve a cost efficient production. The thawing of raw materials of fish and meat is costly.

SUMMARY OF THE INVENTION

This invention solves the problems described above.

BRIEF DESCRIPTION OF THE DRAWINGS

Figure 1:
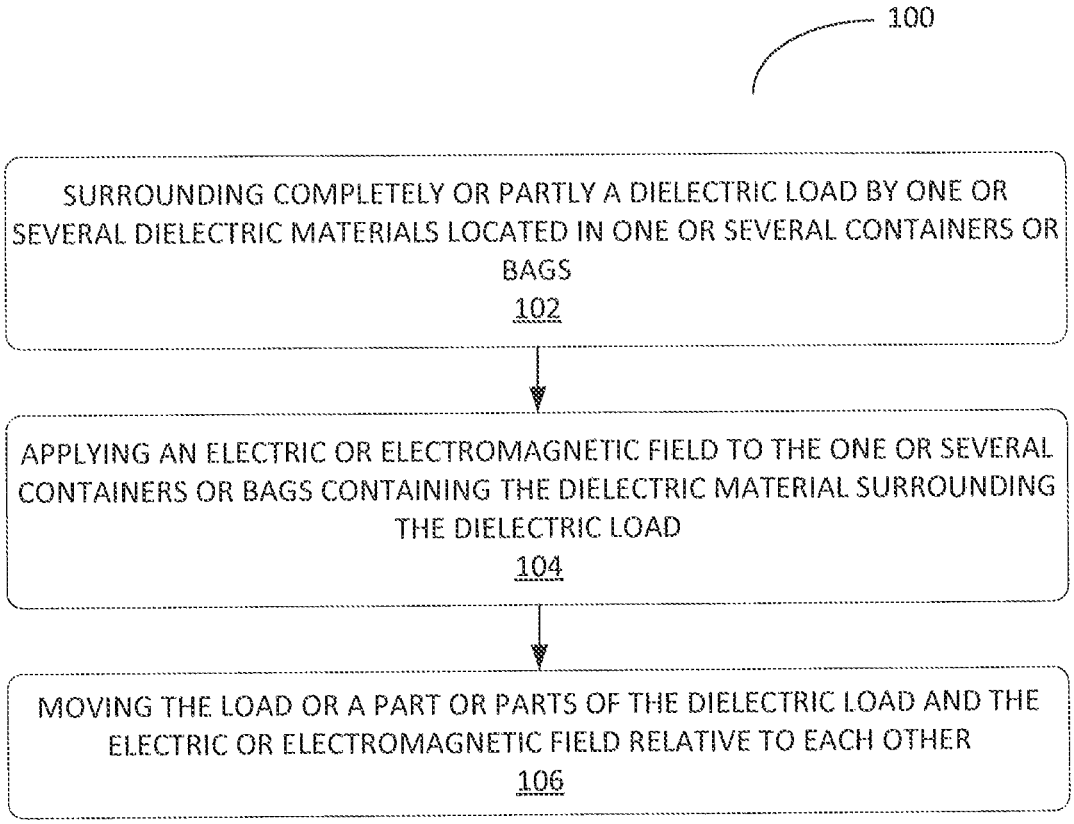
Figure 2:
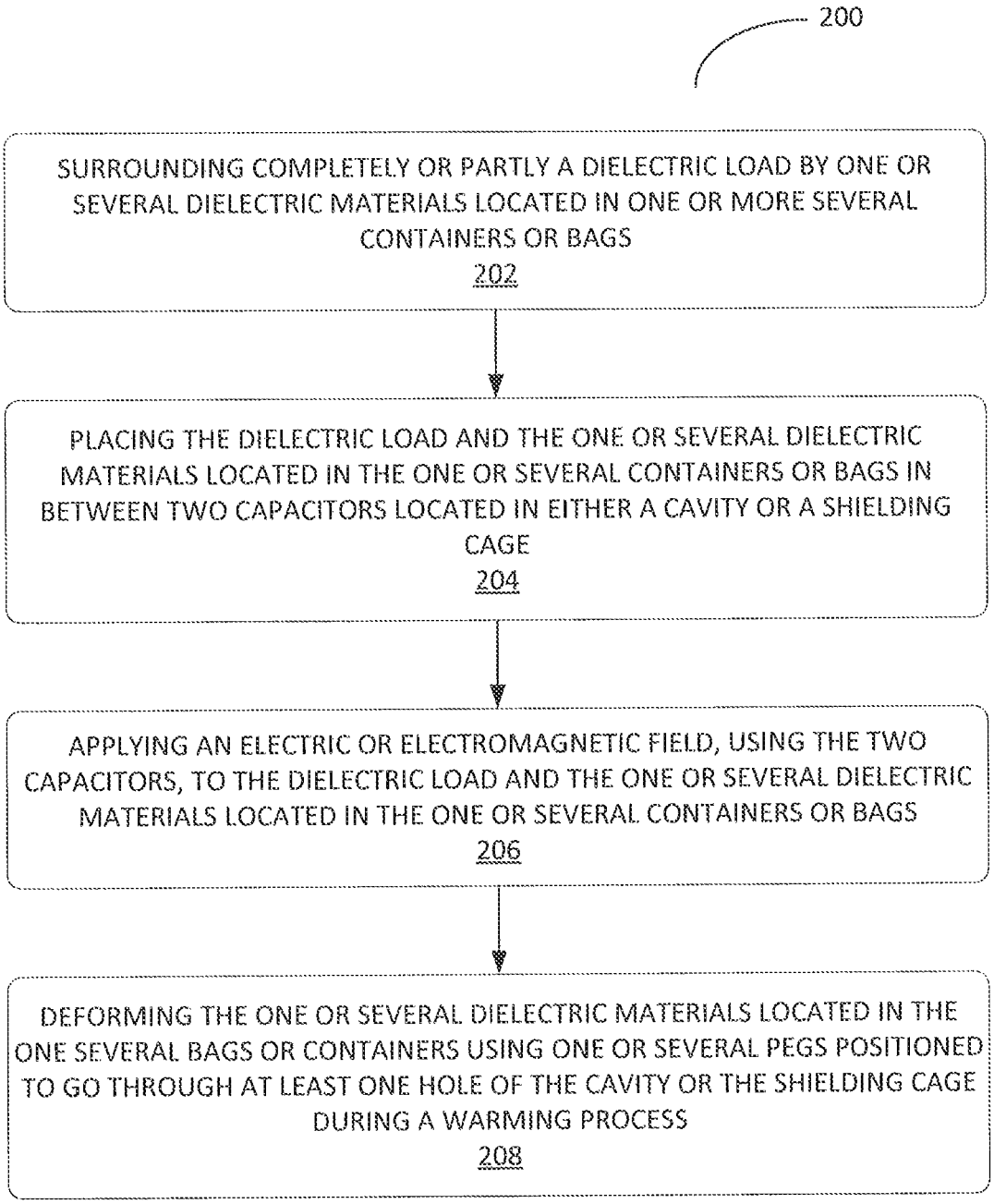
Figure 3:
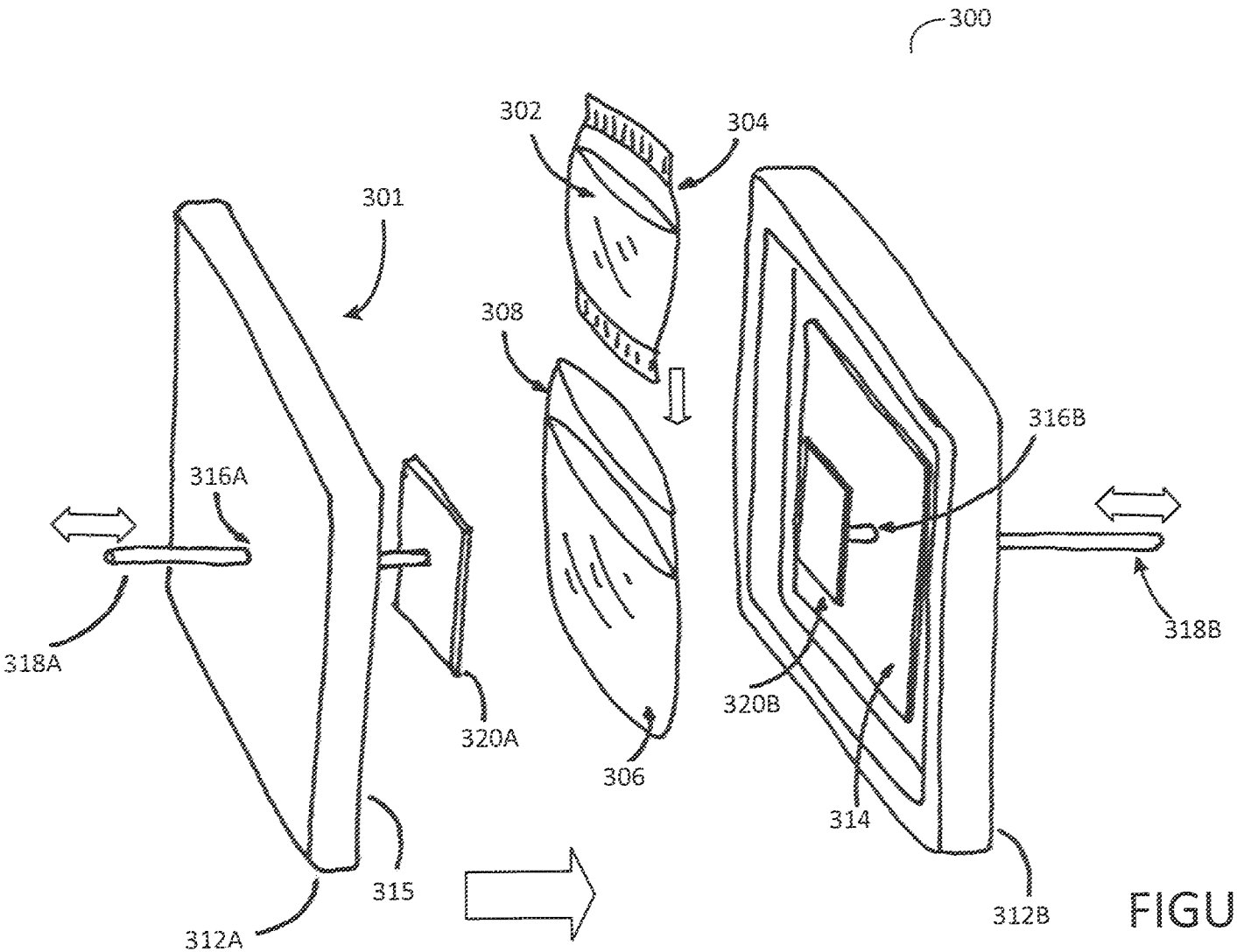

Having thus described embodiments of the invention in general terms, reference will now be made to the accompanying drawings, where:

FIG. 1 provides a flow diagram illustrating a method for reducing overheating of areas in a dielectric load, in accordance with several embodiments of the present invention;

FIG. 2 provides a flow diagram illustrating a method for reducing overheating of areas in a dielectric load, in accordance with several embodiments of the present invention; and FIG. 3 provides a diagram illustrating an appliance for reducing overheating of areas in a dielectric load, in accordance with several embodiments of the present invention.

DETAILED DESCRIPTION OF EMBODIMENTS OF THE INVENTION

Embodiments of the present invention now may be described more fully hereinafter with reference to the accompanying drawings, in which some, but not all, embodiments of the invention are shown. Indeed, the invention may be embodied in many different forms and should not be construed as limited to the embodiments set forth herein; rather, these embodiments are provided so that the disclosure may satisfy applicable legal requirements. Like numbers refer to like elements throughout.

With reference to FIG. 3, elements of FIG. 3 will be referenced as necessary throughout the specification.

In reference to FIG. 1, to master the problems with the previously described edge effects, the load 302 and the surrounding dielectric material 306 are exposed to an electric/electromagnetic field at frequencies below 900 MHz, still better below 300 MHz, as illustrated in block 104 of FIG. 1. Further described by block 106, the field is moved more or less continuously relative to the load 302. In this way zones in the load 302, with higher field strength, are moving around in the load 302 and the risk for local overheating is eliminated. This can be accomplished in different ways.

A dielectric load 302 is surrounded completely or partly by a dielectric material whose dielectricity constant is similar to the dielectricity constant of the load 302 and with a small loss factor compared to the load 302, as identified in block 102 of FIG. 1.

Referring now to FIG. 2, the load 302 with the surrounding dielectric material is placed in an electric/electromagnetic field, for example between a pair of capacitor plates 314/315, as illustrated in block 204 of FIG. 2. Between the capacitor plates 314/315 an alternating electric field is generated. By moving the load 302 or parts of the load 302 and the surrounding dielectric material within the electric/electromagnetic field, the field will chose different paths through the load 302 and the surrounding dielectric material. The field strength in different parts of the load 302 and surrounding dielectric material is altered dynamically and local field concentrations to small areas are avoided.

Alternatively only the load 302 is moved relative to the electric/electromagnetic field and the surrounding dielectric material. The latter is possible if the load 302 is a solid or a liquid within a container and the surrounding dielectric material is a liquid. In this way two different means contribute to a homogenous energy distribution. On one hand the load 302 is moved relative to a field strength concentration within the load 302, on the other hand the field distribution is affected thus the field is moved relative to the load 302 and surrounding dielectric material.

Alternatively the electric/electromagnetic field can be made to move relative to the load 302 and surrounding dielectric material. It can be done by moving the capacitor plates 314/315 meanwhile the load 302 and surrounding is fixed. Thus the field distribution is moved relative to the load 302 and surrounding material.

Overheating can be overcome using a combination of the steps found in the examples above.

Referring now to FIG. 2, it is also possible to place a dielectric load 302 surrounded by a dielectric load 302 according to previous examples, as illustrated in block 202. The load 302 may consist of a solid material, a plastic and/or elastic material or a liquid within a container 304 or a frozen material within a container 304 thawing during a warming process. The surrounding dielectric material 306 may be a liquid within some sort of containers/bags 308 with flexible walls sides. The load 302 is placed in such way that it is completely or partly surrounded/in contact with such containers/bags 308 filled with dielectric liquid 306. In its most simple form it can be a dielectric load 302 placed between two bags/containers 308 with flexible walls containing a dielectric liquid 306 with required properties.

The load 302 and the bags/containers 304 are placed in an electric/electromagnetic field with one or several frequencies below 900 MHz and still better below 300 MHz, as illustrated in block 206 of FIG. 2. The electric/electromagnetic field is made moving in the load 302 by mechanically deforming one or several of the bags 304 surrounding the load 302, as illustrated in block 208 of FIG. 2. This moving of the field is a result of the law of refraction.

Further illustrated in block 208 of FIG. 2, deformation can be made in different ways. For example pegs 318A/318B going through holes 316A/316B in capacitor plates 314/315 or cavity walls 312A/312B. The pegs 318A/318B can be designed in various ways. Between pegs 318A/318B and the field equalized material 306 may be one or several plates for deformation 320A/320B. The pegs 318A/318B push on the plates 320A/320B and the plates 320A/320B push on the field equalized material 306. The pegs 318A/318B may be attached to the plates 320A/320B; the plates 320A/320B may also be an integrated part of the container/containers 308 containing field equalized material 306.

Between the load 302 and the field equalized material 306 there may be one or several layers of one or several materials, for example the material containing the field equalizing material 306. Should the material/materials have an unfortunate combination of thickness, dielectricity constant, and loss factor, warm areas may appear. The law of refraction and the principle of field energy per unit and volume are crucial. The material and design are selected in such a way that the material 304 enclosing the load 302 and/or the field equalizing dielectric material 306 is affected marginally.

If a layer/layers as above, in-between the load 302 and field equalizing material 306, is/are relatively thick with a large constant of dielectricity, the electric field will tend to turn and refract which may cause local heat in some areas. This is particularly a problem if the layer/layers between the load 302 and the field equalizing material 306 are thick and have a large dielectricity constant in relationship to applied wavelength in vacuum. If the loss factor/factors of the material/materials, the layer/layers between the load 302 and the field equalizing material 306 are large it is a risk for local overheating in the above mentioned layer/layers.

To assure no overheating in the layer/layers in-between the load 302 and equalizing material 306 occurs the thickness of the layer/layers shall be less than 1% of applied wavelength in vacuum, still better 0.5% of applied wavelength in vacuum and best of all 0.1% of applied wavelength in vacuum and a constant of dielectricity/dielectricities in vacuum below 200% of the average dielectricity constant of the load 302, better 100% of the dielectricity constant of the load 302, still better 50% of the average loss factor of the load 302 and preferably 25% of the average loss factor of the load 302.

To make sure a container 308 with field equalizing material 306 has made good contact with the load 302 it is completely or partly made of a flexible material and the flexible parts of the container 308 are in contact with the load 302. The flexible material may not be too thick as well as the modulus of elasticity and tensile strength is favorable. The flexible material in contact with the load 302 shall have a thickness less than 5 mm, still better less than 3 mm and preferably below 1 mm and a modulus of elasticity at 20 shall be in the interval 0.05-4 GPa, still better 0.1-3 GPa and preferably 0.2-2 GPa and a tensile strength shall be within the interval 1-200 MPa, still better 2-100 MPa and preferably 6-80 MPa.

Different loads 302 have very different shapes, even if the flexible material in-between the load 302 and the equalizing material 306 are thin and easy to shape. Minor spaces of air may appear between load 302 and the flexible material.

It is favorable to choose the thickness and material properties of the flexible material in such a way that the cubic root of the space volume during the entire thawing/warming process is below 4% of shortest applied wavelength, better 2% of shortest applied wavelength, still better 1% of shortest applied wavelength and preferably 0.5% of shortest applied wavelength.

A load 302 (for example frozen blood plasma) with surrounding field equalizing material 306 is placed in a cavity 301 equipped with an antenna/applicator. The antenna/applicator generates an electromagnetic field below 900 MHz, alternatively below 300 MHz. The load 302 with field equalizing material is placed between applicator/antenna and cavity walls 312A/312B. The equalizing material 306 consists of one or more liquids within one or more flexible or partly flexible container/containers 308 surrounding the load 302 completely or partly. The equalizing material 306 may consist of de-ionized water within bags made of polyethylene.

The deformation of the containers/bags 308 with dielectric material surrounding the load 302 partly or completely is done mechanically; the containers 308 with dielectric material are deformed utilizing pressure on one or more spots/areas. Thus the electric/electromagnetic field will move within the load 302 and overheating is avoided. The bags/containers 308 will be deformed one or several times during the warming process. Practically this is done that one or several pegs 318A/318B are going through one or several holes 316A/316B in the cavity. These rods 318A/318B are pushed alternately in and out of the cavity 301. In order to avoid possible leakage of electric/electromagnetic radiation the longest distance between two opposite points within the holes 316A/316B are smaller than 5% still better 2% and preferably 1% of applied wavelength in vacuum corresponding to the lowest applied frequency.

Alternatively the load 302 with surrounding dielectric material 306 can be placed between capacitor plates 314/315 within a shielding case 301. The holes 316A/316B in the case 301 correspond to the holes 316A/316B in the cavity 301 above.

It should be understood that the invention is not limited in its application to the details of construction and arrangements of the components set forth herein. The invention is capable of other embodiments and of being practiced or carried out in various ways. Variations and modifications of the foregoing are within the scope of the present invention. It should also be understood that the invention disclosed and defined herein extends to all alternative combinations of two or more of the individual features mentioned or evident from the text and/or the drawings. All of these different combinations constitute various alternative aspects of the present invention. The embodiments described herein explain the best modes known for practicing the invention and will enable others skilled in the art to utilize the invention.

Although the invention has been described by reference to specific embodiments, it should be understood that numerous changes may be made within the spirit and scope of the inventive concepts described. Accordingly, it is intended that the invention not be limited to the described embodiments, but that it have the full scope defined by the language of the following claims.

The invention claimed is:

1. An appliance for reducing overheating of areas in a dielectric load placed in an electric or electromagnetic field at one or several frequencies below 900 MHz, wherein the dielectric load is surrounded completely or partly by one or several dielectric materials located in one or several containers or bags, wherein the dielectric load and surrounding dielectric material are placed between two capacitor plates located in either a cavity or a shielding cage, with at least one hole located in walls of the cavity or in walls of the shielding cage surrounding the two capacitor plates, wherein one or more pegs are positioned to go through the at least one hole in the cavity or in the shielding cage to thereby deform the surrounding dielectric material during a warming, wherein an equalization of heat in the load is obtained by moving the load or a part or parts of the load and the electric or electromagnetic field relative to each other, and wherein the electric or electromagnetic field is made to move in the load by mechanically deforming the one or several of the containers or bags containing the dielectric material surrounding the load via movement of the one or more pegs.

2. An appliance according to claim 1 characterized by the dielectric load and the surrounding dielectric material is moved relative to the surrounding electric or electromagnetic field.

3. An appliance according to claim 1, wherein the containers or bags comprise walls made of flexible or partly made of flexible material.

4. A device for reducing overheating of areas in a dielectric load placed in an electric or electromagnetic field at one or several frequencies below 900 MHz, wherein the dielectric load is surrounded completely or partly by one or several dielectric materials located in one or several containers or bags, wherein the dielectric load and the surrounding dielectric materials are placed between two capacitor plates located in either a cavity or a shielding cage, with at least one hole located in walls of the cavity or in walls of the shielding cage surrounding the two capacitor plates, wherein one or more pegs are positioned to go through at least one hole in the cavity or in the shielding cage to thereby deform the surrounding dielectric material during a warming, wherein an equalization of heat in the load is obtained by moving the load or a part or parts of the load and the electric or electromagnetic field relative to each other, and wherein the electric or electromagnetic field is made to move in the load by mechanically deforming the one or several of the containers or bags containing the dielectric material surrounding the load via movement of the one or more pegs.

5. A device according to claim 4 characterized by that the surrounding dielectric material is partly or completely a one or more liquids within flexible or partly flexible containers or bags.

6. A method for reducing overheating of areas in a dielectric load placed in an electric or electromagnetic field at one or several frequencies below 900 MHz, said method comprising:

surrounding completely or partly the dielectric load by one or several dielectric materials located in one or several containers or bags;

placing the dielectric load and surrounding dielectric material between two capacitor plates located in either a cavity or a shielding cage, with at least one hole located in walls of the cavity or in walls of the shielding cage surrounding the two capacitor plates, wherein one or more pegs are positioned to go through the at least one hole in the cavity or the shielding cage to thereby deform the surrounding dielectric material during a warming process; and equalizing heat in the load by moving the load or a part or parts of the load and the electric or electromagnetic field relative to each other, and wherein the electric or electromagnetic field is made to move in the load by mechanically deforming the one or several of the containers or bags containing the dielectric material surrounding the load via movement of the one or more pegs.

7. A method according to claim 6, wherein moving the load or a part or parts of the load and the electric or electromagnetic field further comprises moving the dielectric load and the surrounding dielectric material relative to the surrounding electric or electromagnetic field.

* * * * *